US006023862A

United States Patent [19]

Sirjola

[11] Patent Number: 6,023,862

[45] Date of Patent: Feb. 15, 2000

[54] CONTROL SYSTEM FOR ROPE BUCKET

[75] Inventor: Juhani Sirjola, Hyvinkää , Finland

[73] Assignee: KCI Konecranes International PLC, Hyvinkaa, Finland

[21] Appl. No.: 09/155,052

[22] PCT Filed: Aug. 8, 1997

[86] PCT No.: PCT/FI97/00468

§ 371 Date: Sep. 23, 1998

§ 102(e) Date: Sep. 23, 1998

[87] PCT Pub. No.: WO98/06657

PCT Pub. Date: Feb. 19, 1997

[30] Foreign Application Priority Data

Aug. 9, 1996 [FI] Finland ..... 963135

[51] Int. Cl.[7] ..... E02F 3/58; B66C 11/16

[52] U.S. Cl. ..... 37/397; 37/401; 37/461; 37/187; 254/286; 254/293; 212/320; 212/322

[58] Field of Search ..... 37/394, 395, 396, 37/397, 400, 401, 461, 187, 188; 414/561; 254/278, 283, 286, 293; 212/320, 322

[56] References Cited

U.S. PATENT DOCUMENTS 572,491 12/1896 Locher ..... 212/320 X
849,257 4/1907 Moss ..... 212/322 X
2,720,327 10/1955 Bain ..... 254/278 X
2,776,758 1/1957 Snow, Jr. ..... 254/283 X
4,343,406 8/1982 Noly .

FOREIGN PATENT DOCUMENTS 4 96483 4/1930 Germany .
2 207228 10/1972 Germany .
2 154743 5/1973 Germany .
1-4126508 2/1993 Germany .

OTHER PUBLICATIONS

Heinz Althoff et al.; "Stacking Blending Reclaiming of Bulk Materials"; Series on Bulk Materials Handling . vol. 1 (1975/77) No. 5; Trans Tech Publications; p. 571–581.

*Primary Examiner*—H. Shackelford
*Attorney, Agent, or Firm*—Birch, Stewart, Kolasch & Birch, LLP

[57] ABSTRACT

A control system for a rope bucket, the rope bucket being designed for the hoisting and transfer of materials and adapted to be suspended from a hoist trolley transferable along an essentially horizontal travel path. The control system includes a hoist mechanism for hoisting the rope bucket, and a close mechanism for closing and opening the scoops of the rope bucket, and also for hoisting and lowering the rope bucket. The hoist mechanism includes two separate mechanisms, and similarly the close mechanism includes two separate mechanisms which also form the transfer mechanism of the hoist trolley.

4 Claims, 4 Drawing Sheets

CONTROL SYSTEM FOR ROPE BUCKET

Figure 1:
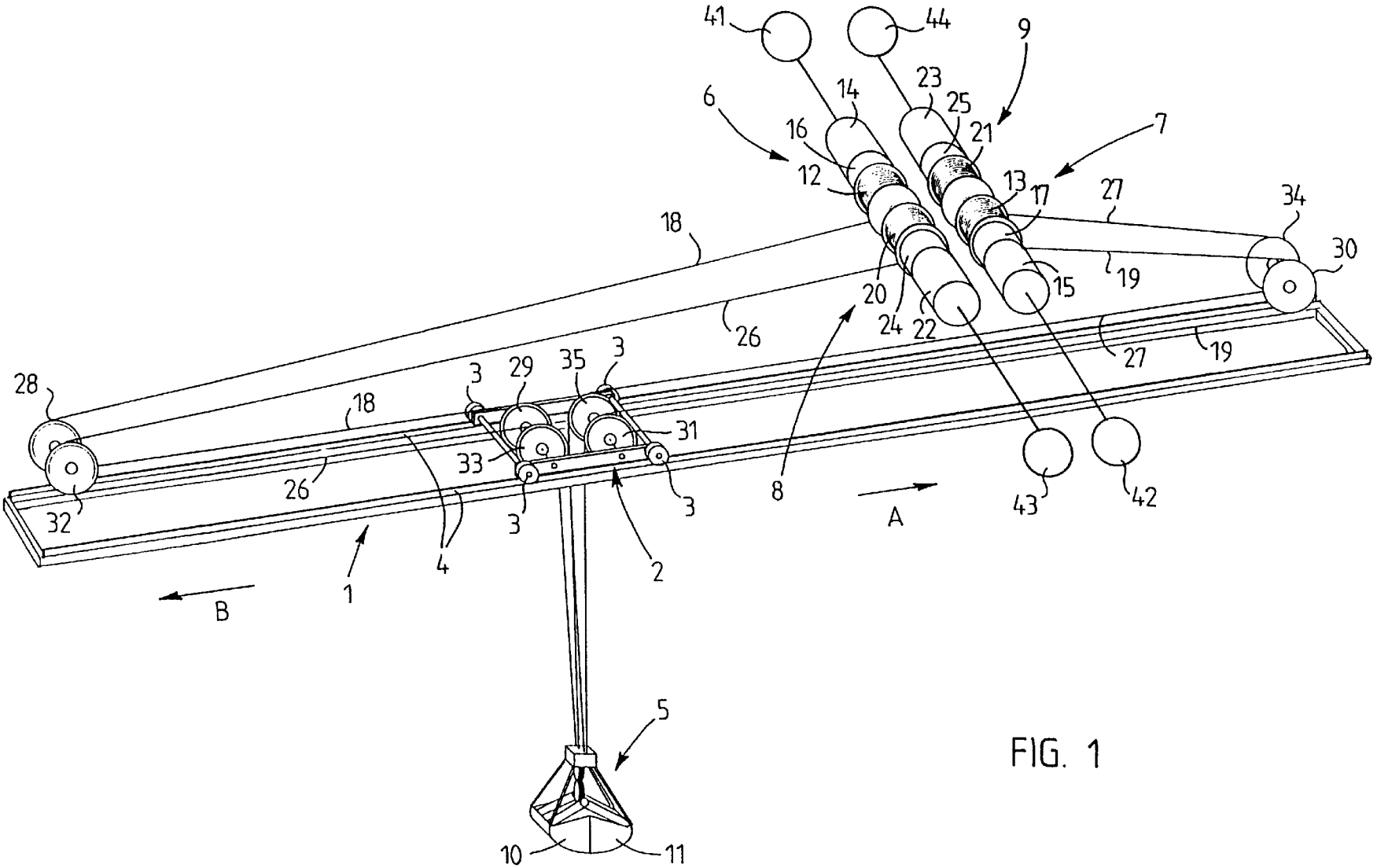

This application is the national phase under 35 U.S.C. §371 of prior PCT International Application No. PCT/FI97/00468 which has an International filing date of Aug. 8, 1997 which designated the United States of America, the entire contents of which are hereby incorporated by reference.

BACKGROUND OF THE INVENTION

The invention relates to a control system for a rope bucket, the rope bucket being designed for the hoisting and transfer of materials and adapted to be suspended from a hoist trolley transferable along an essentially horizontal travel path, and the control system comprising a hoist mechanism for hoisting and lowering the rope bucket, the hoist mechanism comprising a motor driven hoist drum and hoisting ropes secured to the rope bucket and the hoist drum intended for spooling in and paying out the hoisting ropes, a close mechanism for closing and opening the scoops of the rope bucket and also for hoisting and lowering the rope bucket, the close mechanism comprising a motor driven close drum and close ropes secured to the rope bucket and to the close drum intended for spooling in and paying out the close ropes, and a transfer mechanism for transferring the hoist trolley along the travel path.

Rope buckets comprise two or more scoops which are pivoted around their support point such that when the scoops are used, they are pressed one against another, whereby the scoops close, and similarly when the scoops are emptied, they are pushed away one from another whereby they open. The scoops, i.e. the bucket is supported and pivoted by means of ropes secured to both the bucket and the rope drums which are rotated by electric motors, the motors typically being DC motors.

In a known, presently generally used hoist solution the ropes supporting the bucket are routed via an auxiliary trolley and fixed rope pulleys or sheaves to the rollers or drums of the hoist and close mechanisms. The hoist mechanism serves to hoist the bucket and its load. The close mechanism again serves to open and close the scoops of the rope bucket, but it also contributes to hoisting and lowering the bucket and its load. The hoist trolley again is moved by its own transfer mechanism. The auxiliary trolley moves at half the speed of the shuttle trolley in order to compensate for the change in rope lengths during a transfer movement. Hoist and close ropes subject the hoist trolley to a horizontal force corresponding to the load, and the auxiliary trolley to a double force. This determines the dimensioning of the transfer ropes of the trolley, four parallel ropes being generally utilized. To account for stretching of transfer ropes, a separate rope tightening mechanism is additionally needed. This prior art is described in detail in e.g. the publication Series on Bulk Materials Handling Vol. 1 (1975/77) No 5—Stacking Blending Reclaiming of Bulk Materials—First Edition 1977, Trans Tech Publications.

The above described prior art forced controlled solution serves to keep the bucket scoops reliably closed during hoists and transfers, but some ropes are subject to unreasonably high rope forces relative to the load being hoisted, leading to a structure that is heavy in every respect. In addition, the system is very complex with a plurality of rope systems and related mechanisms and auxiliary devices serving each specific purpose.

It is the object of the present invention to provide a completely new control system for a rope bucket, eliminating the above drawbacks.

This object is achieved with the control system for a rope bucket according to the invention, characterized mainly in that the hoist mechanism comprises two separate mechanisms, the hoist rope of one hoist mechanism being routed to the hoist trolley from a first direction and from the hoist trolley to the rope bucket, and the hoist rope of the other hoist mechanism being routed to the hoist trolley from a second direction, essentially opposite to the first direction and from the hoist trolley to the rope bucket, that the close mechanism comprises two separate mechanisms, the close rope of one close mechanism being routed to the hoist trolley from said first direction and from the hoist trolley to the rope bucket, and the close rope of the other close mechanism being routed to the hoist trolley from said second direction and from the hoist trolley to the rope bucket, said directions being essentially parallel with the travel path of the hoist trolley, and that said four separate hoist and close mechanisms also form the transfer mechanism for the hoist trolley.

Thus the invention is based on the idea that the hoist and close ropes are routed to the hoist trolley of the bucket from two opposite directions using four completely separate and individually controllable mechanisms. At the same time the hoist trolley is also freely transferable such that its transfer movements may be implemented by said mechanisms which replace and render useless a separate transfer mechanism. The opening and closing functions, and the hoist and transfer movements of the bucket are achieved by controlling the travel directions and relative speeds of the various mechanisms. A rope tightening mechanism is also needless, since each rope is controlled actively at all times by its own mechanism. Such a system has been rendered feasible by abandoning previously mechanically force controlled structures in which the mechanisms and ropes are continuously mechanically coupled one to another, and by moving to completely separate, electrically controlled mechanisms. The system and its functions can be controlled e.g. by a suitable computer program.

Thus the significant advantages of the system of the invention are a simple rope system, only four ropes, and a simple mechanism, as there is no auxiliary trolley or a trolley transfer and rope tightening mechanism. At the same time the support structure of the hoist trolley shortens, force levels reduce and the steel structure lightens. There are significantly fewer rope pulleys and rope folds, and thus the service life of the ropes is longer and the need for maintenance smaller. Separate mechanisms also make the system modular, whereby four mechanisms with moderate effect are needed and they can be mutually identical.

Figure 2:
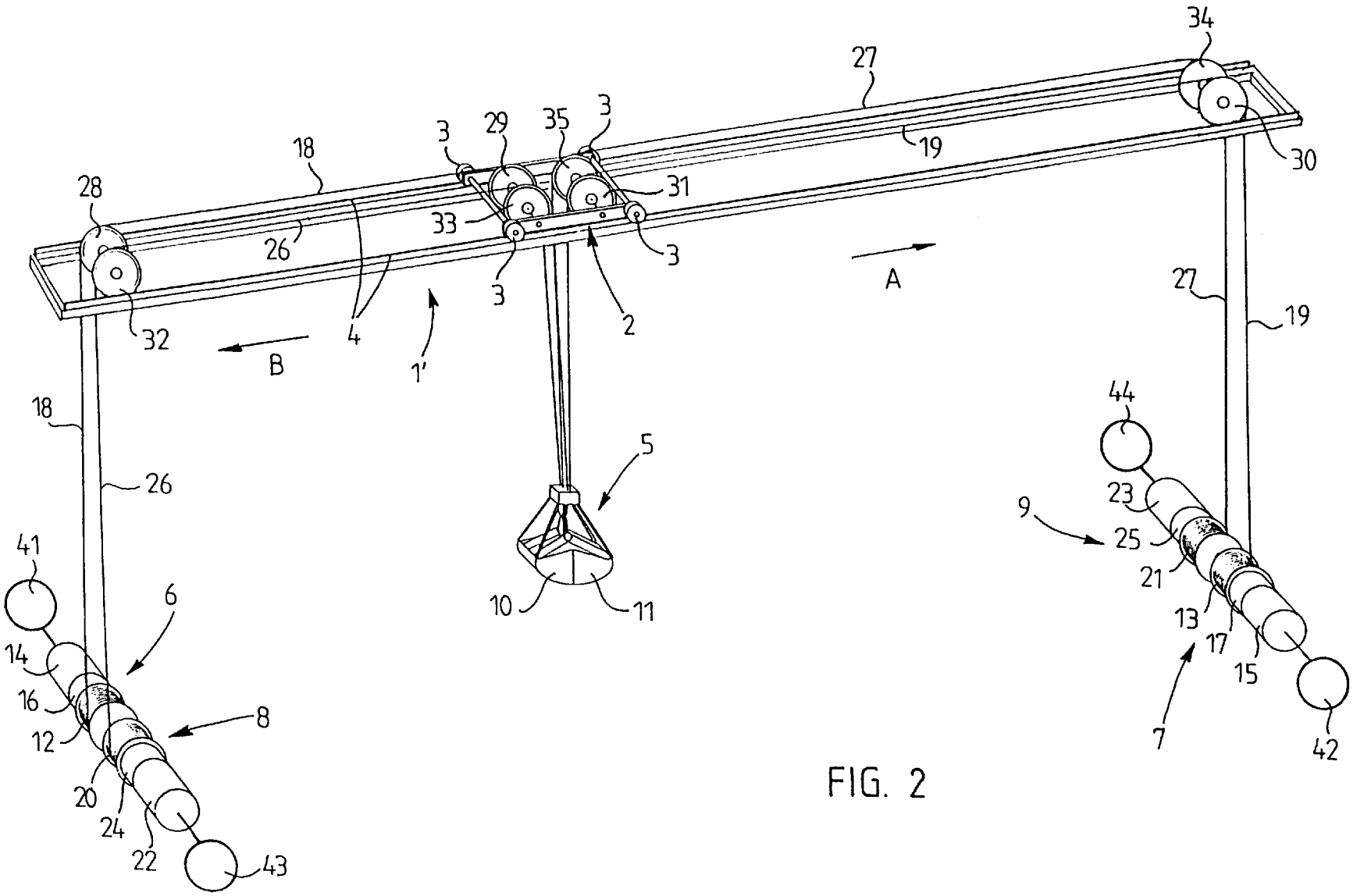
Figure 3:
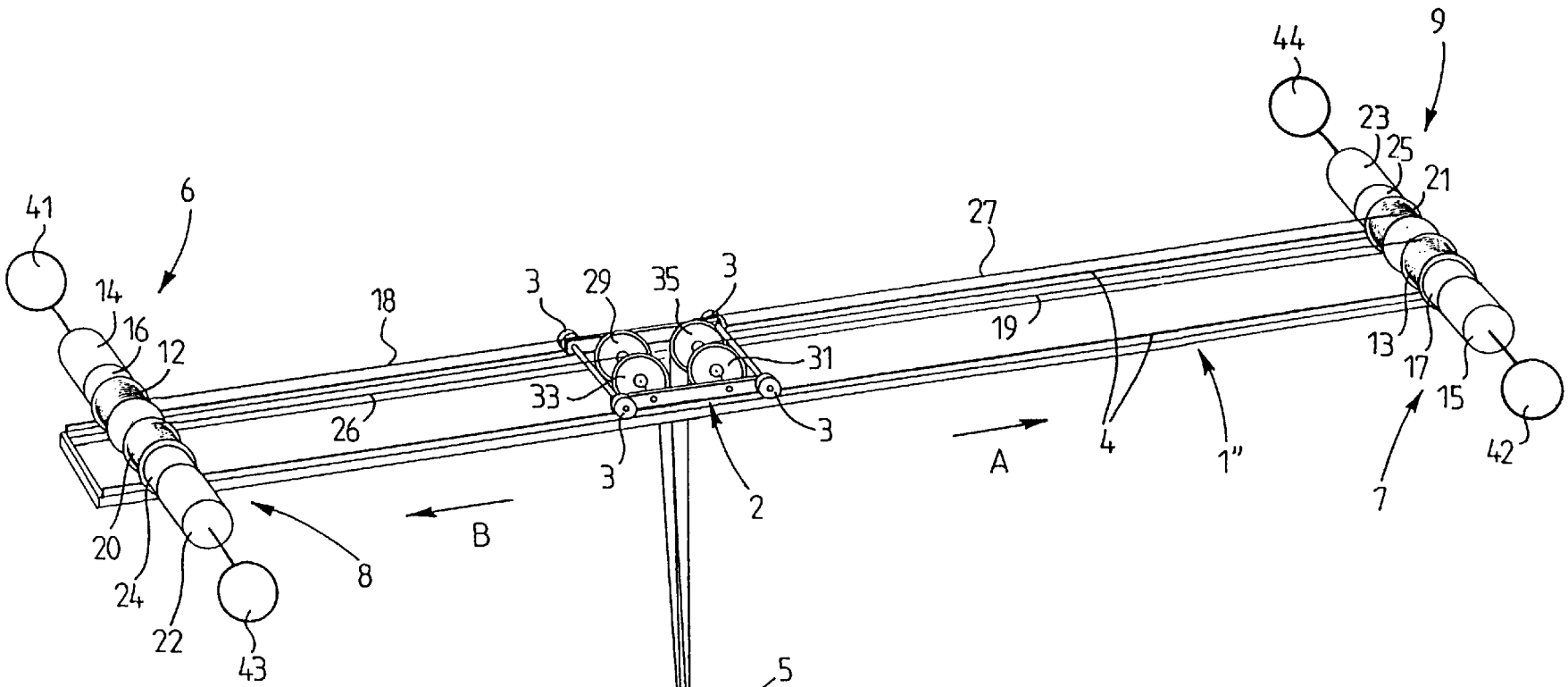
Figure 4:
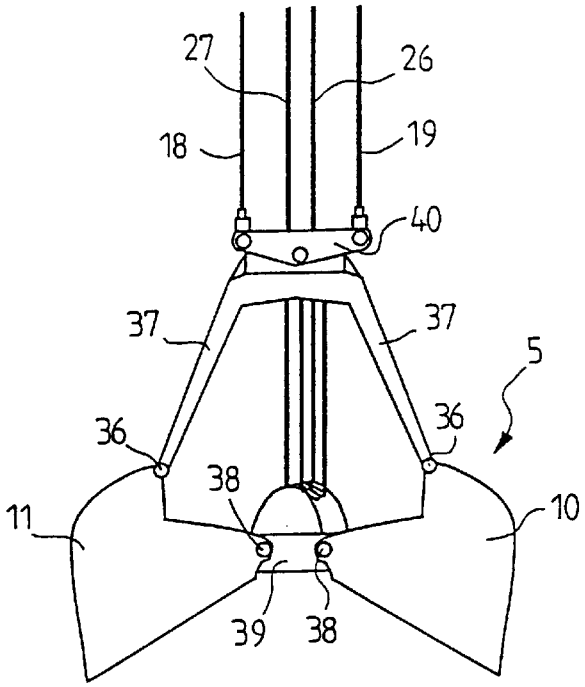
Figure 5:
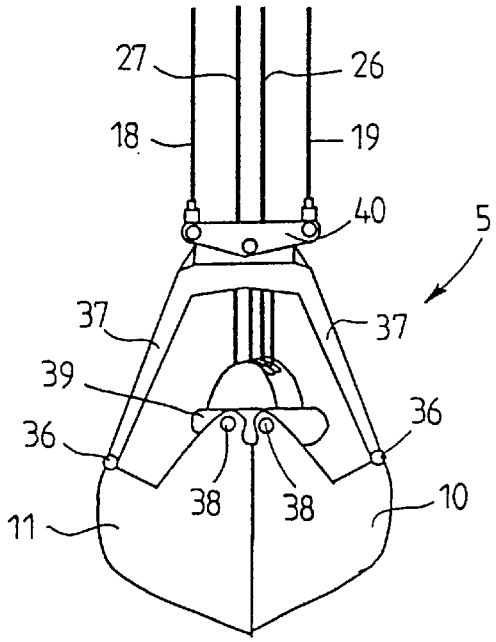

In the following the invention will be described in more detail by means of examples of some preferred embodiments with reference to the attached drawings, in which FIG. 1 shows a rope bucket according to the invention in connection with a bracket gantry crane, FIG. 2 shows a rope bucket according to the invention in connection with a gantry crane, FIG. 3 shows a rope bucket according to the invention in connection with a bridge crane, and FIGS. 4 and 5 show the structure of a rope bucket applicable for use in the arrangements shown in the previous Figures.

In FIG. 1 a rope bucket is shown in connection with a tower crane, of whose support structures are shown a horizontal main girder 1 along which a shuttle trolley 2 serving to transfer and hoist the rope bucket is arranged to travel to and fro. Thus the main girder 1 forms the travel path of the hoist trolley 2. The support structures of the crane and other crane details apparent to those skilled in the art and irrelevant as to the invention have not been shown. The corners of the shuttle trolley 2 comprise wheels 3 by means of which it is arranged to move along the rails 4 of the main girder, and the rope bucket 5 proper is suspended therefrom downwards supported by a rope system to be described below.

The control system for a rope bucket according to the invention comprises electrically controllable hoist and close mechanisms 6 to 9 for performing the hoist and lowering movements of the rope bucket 5, the closing and opening of the bucket scoops 10 and 11, and also the transfer of the hoist trolley along the main girder 1.

The hoist mechanism comprises two completely separate mechanisms 6 and 7 and the close mechanism two complete separate mechanisms 8 and 9. The hoist mechanisms 6 and 7 comprise hoist drums 12 and 13, electric motors 14 and 15 for driving them, including reduction gears 16 and 17, and hoist ropes 18 and 19, coupled to the hoist drums 12 and 13 and to the bucket 5, respectively, the ropes being spooled in on or paid out from said drums. Similarly, the close mechanisms 8 and 9 comprise close drums 20 and 21, electric motors 22 and 23 for driving them, including reduction gears 24 and 25, and close ropes 26 and 27, coupled to the close drums 20 and 21 and to the bucket, respectively, the ropes similarly being spooled in on or paid out from said drums. The above mentioned mechanisms 6 to 9 are placed in the engine house of the crane (not shown ), naturally except for the portions of the ropes leading from the engine room to the rope bucket 5.

The hoist rope 18 of the first hoist mechanism 6 is routed from the corresponding hoist drum 12 via a first sheave 28 at one end of the main girder 1 and a second sheave 29 in the hoist trolley 2 to the rope bucket 5. The hoist rope 19 of the second hoist mechanism 7 is routed from the corresponding hoist drum 13 via a third sheave 30 at the other end of the main girder 1 and a fourth sheave 31 in the hoist trolley 2 to the rope bucket 5.

Similarly, the close rope 26 of the first close mechanism 8 is routed from the corresponding close drum 20 via a fifth sheave 32 at one end of the main girder 1 and a sixth sheave 33 in the hoist trolley 2 to the rope bucket 5. The close rope 27 of the second close mechanism 9 is routed from the respective close drum 21 via a seventh sheave 34 at one end of the main girder 1 and an eight sheave 35 in the hoist trolley 2 to the rope bucket 5.

The most essential point in this control system are the above described four independent mechanisms 6 to 9 and the arrangement of their ropes as described above, i.e. that the hoist rope 18 of one hoist mechanism 6 is routed to the hoist trolley 2 from a first direction (from sheave 28), and the hoist rope 19 of the other hoist mechanism 7 from a second direction, essentially opposite to the first direction (from sheave 30), and that similarly the close rope 26 of a close mechanism 8 is routed to the hoist trolley 2 from said first direction (from sheave 32) and the close rope 27 of the other close mechanism 9 from said second direction (from rope pulley 34), whereby also transfer of the hoist trolley 2 may be arranged in a manner to be described below by means of the hoist and close mechanisms 6 to 7 without any separate trolley transfer mechanism.

Known rope bucket structures, described e.g. in the publication mentioned above, may be used in connection with the arrangement. FIGS. 4 and 5 show an example of a structure. In the case shown the scoops 10 and 11 are secured by joints 36 to outer support arms 37 and by joints 38 to an inner support arm 39. The rope bucket 5 is supported by the hoist ropes 18 and 19, secured to the outer support arms 37 via an intermediate part 40 and the close ropes 26 and 27, routed to sheaves attached to the inner support arm 39 (not shown).

The control of the mechanisms 6 to 9 is effected by a frequency converter 41 to 44 connected to each of the motors 16, 17, 24 and 25, which in turn are controlled by a control logic circuit, designed in accordance with the use and need in question. The frequency converters 41 to 44 may conform with conventional technique and be commercially available devices coupled to the mains in a manner known per se. It is preferably to use AC motors as the motors 16, 17, 24 and 25. It is preferable to couple together the intermediate circuits of the frequency converters 41 and 42 controlling the separate hoist mechanisms 6 and 7, and similarly the frequency converters 43 and 44 controlling the separate hoist mechanisms 8 and 9 for circulating electric power from one mechanism to another during the transfer movement of the hoist trolley.

The opening and closing functions and the hoist and transfer movements of the bucket are achieved by controlling the travel directions and relative speeds of the various mechanisms 6 to 9 as follows:

An example:

Bucket:

Hoist: all drums (12, 13, 20 and 21) are rotated in an upward direction (spooling in of rope)

Lowering: all drums (12, 13, 20 and 21) are rotated in a downward direction (coiling in of rope)

Close: the close rollers (20 and 21) are rotated in an upward direction

Open: the close rollers (20 and 21 are rotated in a downward direction

Drive movement of hoist trolley:

In (direction A):

the hoist rollers 12 and the close rollers 20 are rotated in a downward direction and the hoist rollers 13 and the close rollers 21 are rotated in an upward direction Out (direction B):

the hoist rollers 12 and the close rollers 20 are rotated in an upward direction and the hoist rollers 13 and the close rollers 21 are rotated in a downward direction Hoisting the bucket and driving the hoist trolley in:

The hoist rollers 12 and the close rollers 20 are closed and the hoist rollers 13 and the close rollers 21 are rotated in an upward direction etc.

The control logic of the crate calculates momentary speed directions for each mechanism 6 to 9, the directions implementing bucket 5 movements corresponding to control commands issued by the driver.

In connection with the bucket proper, the ropes 26 and 27 of the close mechanisms 8 and 9 are led to turn the bucket scoops 10 and 11 supported by the joints 36 and 38. In FIG. 4 the scoops are open, whereby the ropes 26 and 27 of the close mechanisms 8 and 9 have been slackened such that the bucket scoops 10 and 11 and the weight of the lower support arm 39 have turned the scoops open. The scoops 10 and 11 again are closed by means of the ropes 26 and 27 of the close mechanisms 8 and 9 such that they pull the lower support arm 39 up, whereby the scoops 10 and 11 turn one against the other and close. In FIG. 5 the bucket scoops 10 and 11 are shown closed.

The bucket control system implemented in connection with a gantry crane as shown in FIG. 2 deviates from that shown in FIG. 1 only in that the first hoist mechanism 6 and the first close mechanism 8 are placed down at a first end of the gantry crane, and the second hoist mechanism 7 and the second close mechanism 9 are placed down at a second end of the gantry crane. A hoist bridge 1' corresponding to the main girder 1 constitutes the travel path of the hoist trolley 2. This solution functions identically to that of FIG. 1. It must be noted, however, that the solution as shown in FIG. 1 is fully applicable in connection with a gantry crane.

The bucket control system implemented in connection with a bridge crane as shown in FIG. 3 deviates from that shown in FIG. 1 in that the first hoist mechanism 6 and the first close mechanism 8 are placed at a first end of the bridge crane and the second hoist mechanism 7 and the second close mechanism 9 are placed at a second end of the bridge crane, whereby said mechanisms 6 to 9 are essentially flush with the hoist bridge, and the hoist and close ropes 18, 19, 26 and 27 are routed from the drums 12, 13, 20 and 21 of the mechanisms 6 to 7 directly via the sheaves 29, 31, 33 and 35 of the hoist trolley 2 to the rope bucket 5. The sheaves 28, 30, 32 and 34 shown in FIG. 1 are thus unnecessary in this solution, making this solution the simplest of the three solutions described. A hoist bridge 1" corresponding to the main girder 1 constitutes the travel path of the hoist trolley 2. As to its function, this solution too completely corresponds to the solution of FIG. 1. In addition it must be mentioned that a solution completely corresponding to FIGS. 1 and 2 may also be used in connection with a bridge crane, should there be any specific need to do so.

In the foregoing the invention has been described only by means of some preferred exemplary implementations. It is possible for those skilled in the art to implement it in other corresponding applications, and to implement its details in a plurality of various ways within the scope of the attached claims. The solution of the invention may also be useful in crane solutions where e.g. a loading means of a container crane replaces the bucket.

I claim:

1. A control system arrangement comprising:

a rope bucket being designed for the hoisting and transfer of materials and adapted to be suspended from a hoist trolley transferable along a main girder, a hoist mechanism for hoisting and lowering the rope bucket, the hoist mechanism comprising motor driven hoist drums and hoisting ropes secured to the rope bucket, the hoist drums intended for spooling in and paying out the hoisting ropes, a close mechanism for closing and opening scoops of the rope bucket and also for hoisting and lowering the rope bucket, the close mechanism comprising motor driven close drums and close ropes secured to the rope bucket and to the close drums intended for spooling in and paying out the close ropes, and a transfer mechanism for transferring the hoist trolley along the main girder, wherein the hoist mechanism comprises two separate mechanisms and the close mechanism comprises two separate mechanisms which are placed in the same engine room, whereby the hoist rope of one hoist mechanism is routed from the corresponding hoist drum via a first sheave at a first end of the main girder and a second sheave in the hoist trolley to the rope bucket, and the hoist rope of the other hoist mechanism is routed from the corresponding hoist drum via a third sheave at a second end of the main girder and a fourth sheave in the hoist trolley to the rope bucket, and the close rope of one close mechanism is routed from the corresponding close drum via a fifth sheave at the first end of the main girder and a sixth sheave in the hoist trolley to the rope bucket, and the close rope of the other close mechanism is routed from the respective close drum via a seventh sheave at the second end of the main girder and an eighth sheave in the hoist trolley to the rope bucket, and that said four separate hoist and close mechanisms also form the transfer mechanism for the hoist trolley.

2. An arrangement as claimed in claim 1, wherein a motor rotates the drum of each separate hoist and close mechanism, each motor being coupled to the associated drum via a reduction gear and equipped with an electric speed control mechanism.

3. An arrangement as claimed in claim 1, wherein the motors are frequency controlled AC motors.

4. An arrangement as claimed in claim 3, wherein intermediate circuits of the electric control mechanism controlling the hoist motors and the electric control mechanism controlling the close motors, respectively, are electrically connected.

* * * * *

UNITED STATES PATENT AND TRADEMARK OFFICE
CERTIFICATE OF CORRECTION

PATENT NO. : 6,023,862

DATED : February 15, 2000

INVENTOR(S): Juhani SIRJOLA

It is certified that error appears in the above-identified patent and that said Letters Patent is hereby corrected as shown below:

On the face of the patent at Box 87, change the PCT Publication Date from "February 19, 1997" to --February 19, 1998--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*